United States Patent [19]

Meister

[11] Patent Number: 4,968,099

[45] Date of Patent: Nov. 6, 1990

[54] FLUID CONTROL SYSTEM FOR ROADWAY GROOVING APPARATUS

[75] Inventor: Donald F. Meister, Overland Park, Kans.

[73] Assignee: Target Products Inc., Kansas City, Mo.

[21] Appl. No.: 310,819

[22] Filed: Feb. 14, 1989

[51] Int. Cl.[5] ..... E01C 23/09

[52] U.S. Cl. ..... 299/1; 299/39

[58] Field of Search ..... 299/36, 38, 39, 1; 404/90, 93; 51/176; 91/514, 533, 420

[56] References Cited

U.S. PATENT DOCUMENTS

| | | | |
|---|---|---|---|
| 2,270,943 | 1/1942 | Freundel et al. | 91/514 |
| 2,311,891 | 2/1943 | Tyson | 299/39 |
| 3,608,969 | 9/1971 | Fowkes | 299/39 |
| 4,353,289 | 10/1982 | Lonnemo | 91/420 |

FOREIGN PATENT DOCUMENTS

| | | | |
|---|---|---|---|
| 1145069 | 3/1985 | U.S.S.R. | 299/39 |

*Primary Examiner*—Bruce M. Kisliuk
*Assistant Examiner*—David J. Bagnell
*Attorney, Agent, or Firm*—Sixbey, Friedman, Leedom & Ferguson

[57] ABSTRACT

A machine for cutting spaced grooves in a concrete road surface includes at least two laterally-spaced hydraulic cylinders which apply downward operating forces on a travelling cutter head. Each cylinder is individually pressurized through a pressure line that incorporates a pressure reducing valve and a pressure relief valve. The pressure setting for the relief valve is slightly higher than the setting of the reducing valve, such that the cylinder pressure is closely maintained between a high limit established by the relief valve and a low limit established by the reducing valve.

7 Claims, 1 Drawing Sheet

FLUID CONTROL SYSTEM FOR ROADWAY GROOVING APPARATUS

BACKGROUND OF THE INVENTION

Field of the Invention

The present invention relates generally to a hydraulic system for imparting lifting and lowering forces to a matched set of cylinders in a groove-cutting machine while maintaining a relatively uniform hydraulic pressure in each cylinder, particularly when applying downward forces on a rotary cutting head. The system compensates for imbalances in the loadings on the cylinders due, for example, to random variations in the position of the cutting head along the machine longitudinal axis, or irregularities in the surface being grooved.

SUMMARY OF THE INVENTION

Various machines have been developed for cutting grooves in concrete road surfaces. One such machine developed by the present inventor is shown in a copending patent application entitled Roadway Grooving Apparatus, Ser. No. 307,816, filed Feb. 7, 1989 and incorporated herein by reference. The machine described in that application includes a rotary cutting head mounted to a sub-frame having a movable carriage that is powered for horizontal motion back and forth along the longitudinal axis of the machine. Four vertically-actuated cylinders are mounted between a main frame and the sub-frame for lifting or lowering the sub-frame that supports the movable carriage.

A rotary cutting head of the type disclosed in the above-referenced patent application typically includes a plurality of closely spaced circular blades arranged to have their edge areas engaged with a concrete road surface to cut grooves therein. A cutting head may include thirty blades arranged to form thirty grooves approximately three sixteenths inch deep. The machine which carries the cutting head is self-propelled for movement along the road surface, either longitudinally parallel to the road centerline or transversely across the longitudinal dimension of the road surface.

Downward operating pressures must be applied on the rotary cutting head during grooving and cutting operations, otherwise the edges of the cutting blades will merely ride along the concrete surface instead of penetrating into the surface to form grooves. In the above-referenced machine, the four vertically-oriented cylinders are used to apply the necessary vertical pressure on the rotary cutting head. The cylinders apply downward forces from the machine main-frame to the machine sub-frame and from the sub-frame the forces are transmitted through the movable carriage to the cutting head.

At times it becomes necessary to raise the rotary cutting head from the concrete surface. For example, when the machine reaches the curb area of a road surface, the cutting head should be lifted while the machine is driven to a new position to begin the next cutting swath. Also, when the machine is being driven from one location to another, or when the machine is being moved onto or off of a transport trailer, it is necessary that the rotary cutting head be in a raised position. The cylinders impart lifting forces to the machine sub-frame, which acts to lift the associated carriage and cutting head.

A general object of the invention is to provide a double-acting hydraulic system for lifting and lowering a cutting head into and out of contact with a pavement surface. The hydraulic system is particularly suited for use with the machine described above.

Another object is to provide such a system which is sensitive to road surface conditions, such that the grooves formed by the cutting head have a fairly uniform depth along the length of each groove.

Still another object of the invention is to provide a hydraulic lifting and lowering system for limiting the forces applied to powered roadway cutting head during cutting operations.

Yet another object of the invention is to provide a hydraulic system that causes a set of double acting cylinders to smoothly and evenly travel both upwardly and downwardly smoothly and evenly, without any tilting or canting of an associated frame being lowered and raised.

BRIEF DESCRIPTION OF THE DRAWINGS

The single FIGURE of the drawing is a schematic diagram of a hydraulic circuit that can be used in the practice of the invention.

DESCRIPTION OF THE PREFERRED EMBODIMENT

Figure 1:
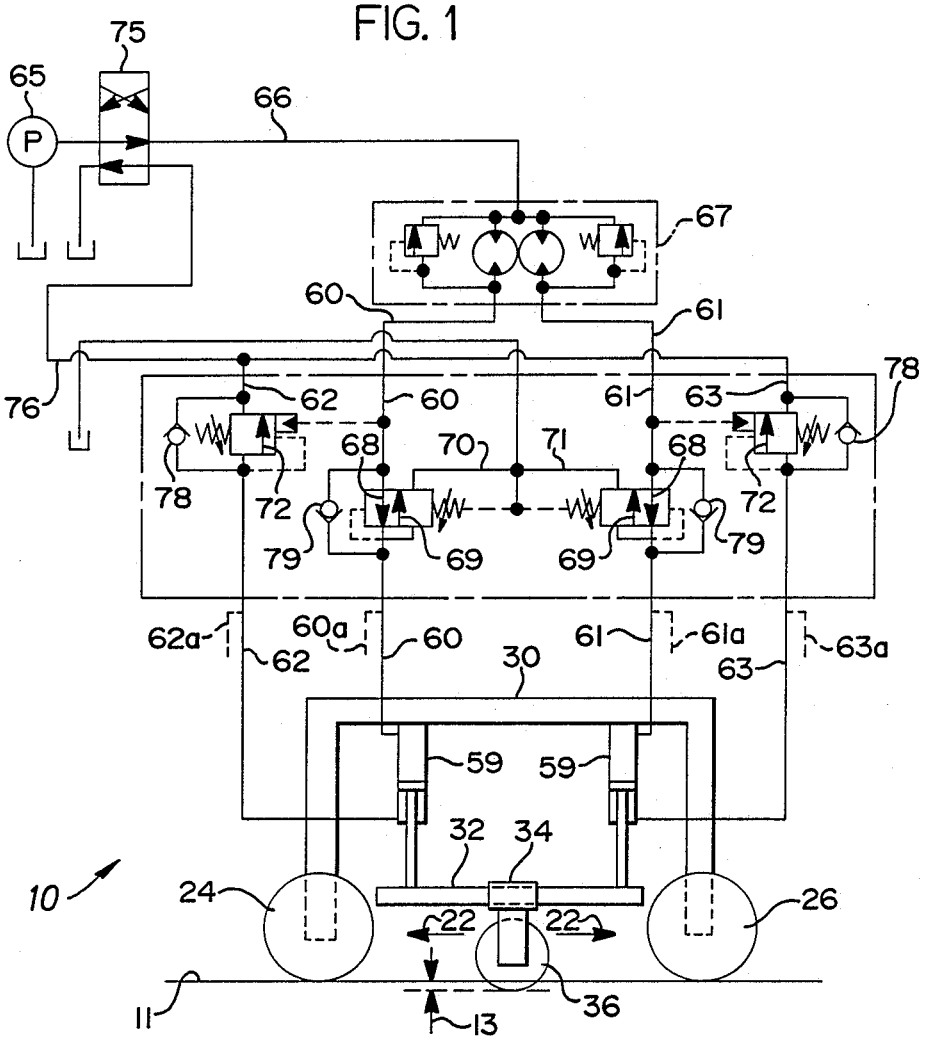

In the attached drawing numeral 10 designates a groove-cutting machine of the type shown more particularly in patent application, Ser. No. 307,816 noted above. The machine includes a main frame 30 connected to two rear wheels 24 and two front wheels 26. Wheels 24 are non-steerable, whereas wheels 26 are steerable and powered.

A rotary cutting head 36 is supported on a carriage 34 that is capable of rolling or sliding motion along sub-frame 32 in the directions of arrows 22. Sub-frame 32 is suspended from main frame 30 by four hydraulic (liquid) cylinders 59 located at corner areas of the sub-frame. The drawing shows two cylinders 59, but in practice there would preferably be four, i.e. two additional cylinders directly behind the illustrated cylinders, although two cylinders can be used instead of four cylinders, if so desired.

Cylinders 59 are double-acting cylinders that impart a downward force or pressure onto sub-frame 32 to cause the groove-forming discs in cutting head 36 to penetrate into the concrete surface. As shown in the drawing, the discs penetrate into the road surface 11 to form grooves having a depth 13. A non-illustrated motor on carriage 34 rotates the cutting discs during the groove-cutting operation. Cylinders 59 can also be used to impart lifting forces to sub-frame 32 to lift cutting head 36 out of contact with the road surface. During periods when cutting head 36 is in the lowered groove-cutting position, the carriage 34 will, at times, be powered to the left or to the right, as represented by arrows 22 such that the cutting head 36 is movable toward road wheels 24 or toward road wheels 26.

Wheels 26 may be powered to move the entire machine bodily in the direction of arrows 22 and carriage 34 may be powered to move cutting head 36 relative to frame 30. By using both these operating modes it is possible to move the machine transversely across a road surface to form grooves substantially across the entire space from one curb to the other curb. The operation can be performed in a single pass of the machine without turning the machine end for end. This is accomplished by initially positioning the cutting head 36 adjacent one edge of the road and driving the machine to the opposite edge with the cutting head fixed adjacent one end of the sub-frame. Upon reaching the opposite edge of the road, the machine is stopped and the rotating cutting head is then driven along the sub-frame toward the edge of the road.

The loadings on cylinders 59 tend to vary according to the position of cutting head 36. For example, as the cutting head moves toward the cylinders 59 located on the left side of the figure, the loading on those cylinders increases whereas the loading on the right cylinders decreases. Similarly, as the cutting head moves to a position near the rightmost cylinders 59, the loading on those cylinders increases whereas the loading on the leftmost cylinders decreases. The cylinder loadings are also affected by irregularities in the concrete surface. As the cutter disks on head 36 contact a bump or high spot on the concrete surface, the loadings on cylinders 59 tend to increase, whereas the cylinder loadings decrease as the cutter discs pass beyond the bump or pass over a low spot.

The cylinders are driven in a direction toward the pavement by separate pressure lines 60 and 61 that are connected to the upper ends of the cylinders to a reservoir or tank. Separate vent lines 62 and 63 are connected to the lower ends of the cylinders for venting liquid from below the respective pistons in the cylinders to a reservoir or tank. The drawing shows two cylinders 59 and two pressure lines 60 and 61. In a system having four cylinders two additional pressure lines and two additional vent lines would be used, as respectively indicated with dashed lines 60*a*, 61*a*, 62*a* and 63*a*.

A pump 65 initially delivers pressurized liquid at a high pressure, e.g. 1000 psi through a single common pressure supply line 66 to a flow splitter device 67. The flow splitter evenly separates the volume of flow between the two separate pressure lines 60 and 61 so that the flow rate in each line 60 and 61 is the same even though the flow resistance and pressure in one line may be higher than the flow resistance and pressure in the other line. The pressure difference can be caused by variances in the loads applied to the cylinders during grooving operations as mentioned above. Flow-splitter 67 can be a commercially available spool operated device or a gear-operated device commercially available from the Fenner Co., as its model FD-1.

Each branch line 60, 61 includes a pressure reducing valve 68 and a pressure relief valve 69. Both valve functions can be incorporated in a single pressure-actuated piston having separate restriction ports and relief ports. Such a unitized design is commercially available from Sun Hydraulics in Sarasota, Fla., as its Model PBDB pressure reducing relieving valve. Alternately, the separate valve functions can be accomplished with separate individual pistons.

The pressure reducing valve 68 reduces downstream pressure, whereas the relief valve opens as a response to an increase in downstream pressure. More particularly, the pressure reducing valve reduces the higher pressure on its upstream side to a lower pressure on its downstream side regardless of the flow rate through the valve, even in a static (zero) flow situation as in the case where the cutting head 36 is locked in a lowered position.

The relief valve 69, which vents to tank in response to an increase in downstream pressure above a preset maximum pressure, maintains a substantially constant pressure on the cutting head. This serves as a safety feature by preventing damage to the rotary cutting blades on the cutting head due to excessive loading on the blades. For example, when the blades encounter a bump or raised area of pavement, the load on the blades increases thereby raising the pressure in the top portions of cylinders 59. By allowing the cylinders 59 to vent hydraulic fluid at a predetermined relief pressure through vent lines 70, 71, the loading of the blades can be limited to acceptable values. In effect, the relief valve 69 allows the cutting head to "float" up and down while cutting or grooving across a pavement surface.

The pressure in each line 60 or 61 upstream of the associated pressure reducing valve 68 is relatively high, e.g. 1000 psi, whereas the pressure below each reducing valve 68 is lower, e.g. 600 psi. Each relief valve 69 is set to open at a pressure value higher than the pressure setting of valve 68, e.g. 625 psi. In this case, the pressure of the liquid supplied to the upper end of each cylinder 59 will vary within an upper limit of 625 psi, established by relief valve 69 and a lower limit of 600 psi established by pressure reducing valve 68. Should the reduced pressure in line 60 or 61 tend to go above the upper limit of 625 psi, the associated relief valve 69 will exhaust some liquid into a line 70 or 71 that leads to a sump tank.

Each vent line 62, 63 includes a flow restriction device 72 for limiting the rate at which liquid can be exhausted from the space below the associated piston in the respective cylinder 59. Each flow restriction device may be a pressure-responsive valve device that responds to a range of pressures in lines 60, 61 to provide a relatively constant flow over the sensed pressure range. Each flow restriction device 72 responds to the pressure (and corresponding load) in each respective line 60, 61 such that the greater the pressure in lines 60, 61 induced by the load of the cutting head, the more the valve portion of the flow restriction device will open.

The flow restriction devices 72 prevent the cylinders from "running away" during the lowering of the cutting head. That is, without the flow restriction devices, the weight of the free falling cutting head 36 would drain the cylinders 59 at an excessive rate and possibly cause damage to the cutting head due to the resulting high impact speed of the cutting head with the pavement. Thus, by employing a flow restriction device 72 in each vent line 62 or 63 it is possible to control the downward rate of motion of each associated piston rod, particularly during the initial operating period when cutting head 36 is being lowered toward the pavement surface.

Moreover, by maintaining the flow rates in lines 62 and 63 substantially the same via flow restriction device 72, it is possible to have each piston rod move downwardly at the same rate regardless of the longitudinal position and corresponding variable load of the cutting head 36. Accordingly, sub-frame 32 will maintain a given attitude relative to main frame 30, without any tilting or canting of the sub-frame. This is most desirable as such tilting generates undue stress on the guides used to guide the sub-frame in its up-and-down motion.

Each flow restriction device 72 acts as a counterbalance valve which, when the cutting head 36 is raised, also serves as a zero-leak load-holding device. That is, a valve in device 72 prevents the cylinders 59 from leaking (venting) when the cutting head 36 is raised and thus prevents the cutting head from creeping downward toward the pavement. A suitable flow restriction device 72 is commercially available from Sun Hydraulics in Sarasota, Fla. as its counterbalance valve, Model CBCA.

Counterbalance valves, such as flow restriction device 72, typically receive a pilot pressure signal which further controls its actuation. As seen in the FIGURE, pilot lines 73, 74 provide the required pilot pressure signals to flow restriction device 72. The pilot pressure must reach a preset minimum value before the counterbalance valve 72 will open. Once open, a further increase in pilot pressure will cause the counterbalance valve 72 to further open to an amount proportional to any further increase in pilot pressure.

The flow restriction devices 72 are designed to maintain a preset pressure in vent lines 62, 63 at a multiple of the minimum pilot pressure required to initiate opening of the valves in the flow restriction devices. For example, if a minimum pilot pressure of 1000 psi is required to initiate the opening of the flow restriction devices, and a pressure ratio of 3:1 is set between lines 60, 61 and lines 62, 63 by appropriately adjusting the flow restriction devices 72, then the pressure in vent lines 62, 63 will be maintained at about 3000 psi, assuming the load of the cutter head 36 is sufficient to generate 3000 psi in the vent lines.

It is desirable to set the counterbalance valves 72 so as to maintain the pressure in vent lines 62, 63 at a value which will prevent the sub-frame 32 and cutting head 36 from falling to the pavement under the force of gravity. Thus, additional force must be provided from pump 65 to cause the cylinders 59 to overcome the preset resistance in vent lines 62, 63 in order to lower the cutting head 36 to the surface. This arrangement ensures that the cylinders 59 will be lowered at a controlled predetermined rate set by the flow rate through the flow splitter 67 and counterbalance valves 72.

A most important relationship exists between the flow splitter 67 and each flow restriction device 72. More specifically, by providing a relatively even volume of hydraulic fluid to each line 60, 61 with a constant flow rate, the flow splitter allows the pressure in one line 60 or 61 to vary without affecting the pressure in the other respective line 60 or 61. The pressures in these lines will vary depending upon the magnitude and direction of the loads applied to cylinders 59 from the cutting head 36.

A pilot pressure signal is taken from each line 60 or 61 and applied to the flow restriction devices 72 via pilot pressure lines 73, 74. The flow restriction devices are designed to provide a greater resistance to flow through lines 62 and 63 in response to a decrease in pressure in lines 60, 61 (and a decrease in the corresponding pressures in pilot lines 73, 74) while maintaining a preset substantially constant flow rate. In this manner, each cylinder 59 will be raised and lowered at an even rate regardless of any variance in loadings between the cylinders.

For example, when the cutter head 36 is positioned at one extreme end of the sub-frame 32, such as beneath the cylinder 59 fed by line 61, the pressure in line 61 will be lower than the pressure in line 60 when sub-frame is being lowered to the pavement. In order to lower both ends of the sub-frame at the same controlled rate, the different pressures in pilot lines 73 and 74 will provide different corresponding pilot signals to the respective flow restriction devices 72.

The lower pressure pilot signal from line 74 will cause its associated flow restriction device 72 to generate a higher pressure in line 63, and the higher pressure signal from line 73 will cause its associated flow restriction device 72 to generate pressure in line 62, thus the movement of the sub-frame can be coordinated for substantially even horizontal planar descent. If the flow into lines 60 and 61 was not "split" as described above, no pressure differential would exist in a common unisolated pair of feed lines and therefore the creation of variable pilot pressure signals would not be possible. This would likely result in one or more counterbalance valves opening and the others remaining completely closed to flow.

Because the flow splitter 67, which serves as an input to the overall fluid control system, maintains a fixed flow rate into the system and because the counterbalance valves 72, which serve as an exit from the fluid control system, maintain a fixed flow rate out of the system, the movements of the cylinders, which are located between the inputs and outputs are mutually coordinated for even and controlled actuation. The system is designed to maintain this fixed flow rate even over large variations in line pressures.

As noted above, each pressure line 60 or 61 has its own pressure reducing valve 68 and pressure relief valve 69. Thus, each line is isolated from the other line, such that pressure variations in line 60 do not affect the pressure in line 61, or vice versa. Each pressure line 60 or 61 operates independently of the other pressure line.

If the pressure in lines 60 or 61 drops below the limit established by valve 68, the valve 68 port will open further to admit additional liquid from the higher pressure zone above valve 68. The valve system in each line 60 and 61 enables each cylinder 59 to maintain an essentially constant downward operating force on sub-frame 32 and the associated cutting head 36. Accordingly, the cutting head is biased within a carefully controlled pressure range to form grooves in the pavement surface that are essentially the same depth measured at different points along the groove length.

A control valve 75 can be adjusted downwardly from its illustrated position so that pump 65 delivers pressurized liquid to line 76 instead of line 66 to lift cutting head 36 away from the pavement surface. As a result, each pressure line 60 or 61 becomes a vent line, and each vent line 62 or 63 becomes a pressure line. A check valve 78 associated with each line 62 or 63 permits essentially unrestricted flow to pressurize the space below the piston in each cylinder 59. A check valve 79 associated with each line 60 or 61 permits liquid to be exhausted from the space above the piston in each cylinder 59.

The hydraulic system is designed so that the fluid circuitry of the cutter head lifting function does not adversely affect machine performance during pavement grooving and cutting periods. The system can readily and quickly shift from an operating mode wherein cylinders 59 exert downward forces on cutting head 36, to a transit mode wherein the cylinders lift the cutting head away from the pavement surface, valve 75 being the mode reversing mechanism.

The drawings show one form that the invention can take. Other forms are possible within the scope of the appended claims.

I claim:

1. In a machine having a cutting head for cutting grooves in a road surface, the improvement comprising:

first and second spaced-apart liquid cylinders operably connected to the cutting head for exerting downward forces thereon;

a separate pressure line connected to one end of each cylinder for pressurizing the cylinder in the downward direction;

a separate vent line connected to the other end of each cylinder to vent liquid therefrom in response to the application of downward forces on the cutting head;

a pressure reducing valve in each separate pressure line, and a pressure relief valve in each pressure line set at a pressure value higher than the setting of the reducing valve, such that the downward force exerted by each cylinder on the cutting head is maintained within an upper limit established by the associated relief valve and a lower limit established by the associated reducing valve; and counterbalance valve means in each separate vent line limiting the rate at which the associated cylinder can move.

2. The improvement of claim 1 and further comprising control valve means operable to reverse the conditions of the aforementioned lines, such that each pressure line becomes a vent line and each vent line becomes a pressure line;

check valve means for shunting liquid around each reducing valve and each relief valve; and second check valve means for shunting liquid around each counterbalance valve means such that the liquid cylinders are enabled to exert lifting forces on the cutting head.

3. The improvement of claim 1, further comprising a common pressure supply line for the two separate pressure lines, and a flow splitter means connected between the common line and separate pressure lines for delivering equal flows to said separate pressure lines.

4. The improvement of claim 1, further comprising control valve means operable to reverse the conditions of the aforementioned lines, such that each pressure line becomes a vent line and each vent line becomes a pressure line;

first check valve means arranged in parallel flow relation to each reducing valve and each relief valve for venting liquid from the associated cylinder when the associated pressure line is acting as a vent line; and second check valve means arranged in parallel flow relation to each counterbalance valve means for delivering pressurized liquid to the associated cylinder when the associated vent line is acting as a pressure line, such that the liquid cylinders are enabled to exert lifting forces on the cutting head.

5. The improvement of claim 1 wherein the cutting head is slidably mounted in the machine for movement through an intervening space defined between the liquid cylinders, whereby the loadings on the individual cylinders vary in accordance with the cutting head position.

6. The improvement of claim 1 wherein each counterbalance valve means is a pressure-responsive device operable to provide a relatively constant flow over a range of pressures in the associated vent line.

7. A fluid control system for a roadway grooving device comprising:

pump means for pressurizing a fluid;

flow splitting means for splitting said fluid from said pump means into a first fluid flow line and a second fluid flow line, said flow splitting means providing substantially equal flow rates in said first and second flow lines;

a first hydraulic actuator having an input connected to said first fluid flow line and a second hydraulic actuator having an input connected to said second fluid flow line;

first valve means connected to an output line of said first hydraulic actuator and second valve means connected to an output line of said second hydraulic actuator, a first pilot pressure line in fluid communication with said first fluid flow line and with said first valve means, a second pilot pressure line in fluid communication with said second fluid flow line and with said second valve means, and said first and second valve means being respectively controlled by fluid pressures in said first and second pilot pressure lines such that an increase in said fluid pressures in said first and second pilot pressure lines above a predetermined minimum actuation pressure respectively causes said first and second valve means to open to allow fluid to pass therethrough at a substantially constant flow rate.

* * * * *